United States Patent [19]

Plowman et al.

[11] Patent Number: 4,995,759

[45] Date of Patent: Feb. 26, 1991

[54] DRAINAGE TUBE CONSTRUCTION

[75] Inventors: Jeffrey D. Plowman, Prinsburg; Arnold H. Plowman, Willmar, both of Minn.

[73] Assignee: Multi-Flow Tube, Inc., Prinsburg, Minn.

[21] Appl. No.: 267,969

[22] Filed: Nov. 4, 1988

[51] Int. Cl.[5] ..... E02B 11/00

[52] U.S. Cl. ..... 405/43; 138/111; 138/121; 405/36; 405/45

[58] Field of Search ..... 405/43, 45, 46–49, 405/50, 36; 52/169.5, 169.14; 138/111, 105, 115, 116, 117, 177, 121

[56] References Cited

U.S. PATENT DOCUMENTS

| | | | |
|---|---|---|---|
| 425,913 | 4/1890 | Smith | 138/115 X |
| 463,871 | 11/1891 | Reading | 405/48 |
| 554,322 | 2/1896 | Thorpe | 138/115 |
| 2,084,351 | 6/1937 | Luce | 405/43 X |
| 2,608,828 | 9/1952 | Dimick | 405/47 |
| 2,866,319 | 12/1958 | Nicholson | 405/46 |
| 2,874,844 | 2/1959 | Wanner | 405/43 X |
| 3,907,679 | 9/1975 | Yost | 210/532.2 X |
| 3,965,686 | 6/1976 | Saito et al. | 405/43 |
| 3,998,065 | 12/1976 | Darnell | 405/43 |
| 4,045,964 | 9/1977 | Barclay | 52/169.5 X |
| 4,288,321 | 9/1981 | Beane | 405/45 X |
| 4,622,138 | 11/1986 | Wage | 405/50 |
| 4,741,593 | 5/1988 | Fochler | 138/111 X |
| 4,904,113 | 2/1990 | Goddard et al. | 405/49 X |

FOREIGN PATENT DOCUMENTS

| | | | |
|---|---|---|---|
| 1964769 | 9/1970 | Fed. Rep. of Germany | 52/169.14 |
| 2757200 | 7/1979 | Fed. Rep. of Germany | 52/169.14 |
| 3136403 | 4/1983 | Fed. Rep. of Germany | 405/43 |
| 6401043 | 8/1964 | Netherlands | 405/49 |
| 15391 | of 1907 | United Kingdom | 405/43 |

OTHER PUBLICATIONS

Controlled-Porosity Pipe Dewaters Dune Sand Civil Engineering, Nov. 1958, (vol. P 855) p. 75.

*Primary Examiner*—Dennis L. Taylor
*Attorney, Agent, or Firm*—Gregory P. Kaihoi

[57] ABSTRACT

A ground drainage system includes a relatively narrow, elongated trench disposed along a roadway (or agricultural field); and a drainage tube construction disposed in the trench. The tube construction including a plurality of longitudinally extending, substantially tangential and generally parallel corrugated tubes oriented with respect to one another in a linear fashion. In transverse cross-section the portions attaching the tubes to another define a generally straight line perpendicular to the longitudinal dimension of the tubes. The tubes are generally vertically stacked with respect to one another. The corrugations are defined by alternating ribs and valleys. Each tube has perforations in the valleys to allow fluid to enter therein and be drained away.

9 Claims, 6 Drawing Sheets

DRAINAGE TUBE CONSTRUCTION

This application is a continuation-in-part of U.S. patent application Ser. No. 053,173, filed May 21, 1987, now abandoned.

TECHNICAL FIELD

The invention relates to a drainage system for use in draining unwanted water from areas of land such as roadways, agricultural lands, building foundations, and the like.

BACKGROUND ART

In a variety of industrial applications including agriculture, building construction, and road construction, by way of example, it is necessary or desirable to provide soil drainage to remove unwanted water. In agriculture, low spots in fields frequently are drained to prevent accumulation of excess moisture which would inhibit crop growth and yield. In construction, removal of pore water is frequently necessary to reduce unwanted settling of a structure due to gradual dewatering of saturated, compressible soils. See, e.g., U.S. Pat. No. 4,622,138.

In road construction, moisture immediately beneath the pavement surface causes distresses of varying types which may rapidly destroy the pavement. In flexible pavement systems, distresses may be caused by either water alone or in combination with temperature variations. Such distresses include potholes, loss of aggregates, raveling, weathering, alligator cracking, reflective cracking, shrinkage cracking, and heaving from repeated frost/thaw cycles and/or swelling soils. Rigid pavement system distresses include faulting, joint failure, pumping, various types of cracking, blow-up or buckling, surface spalling, steel corrosion, and heaving from frost/thaw and/or swelling soils. These distresses are discussed in more detail in U.S. Pat. No. 4,572,700.

A variety of drainage systems have been employed over the years in attempts to provide economical drainage systems to accomplish desired drainage objectives. Early drainage systems comprised filling trenches with sand and coarse aggregates in place of indigenous soils less permeable to water, such as clay. An improvement on these systems utilized synthetic textile fabrics (geotextiles) as a trench liner, filled with a coarse aggregate to support the fabric. Geotextiles prevent the aggregate from clogging with silt, thereby defining a drainage passageway. More recently, round perforated tubing has been used, typically placed in an aggregate filled trench, sometimes in combination with a geotextile covering the perforated conduit. See, e.g., U.S. Pat. No. 3,830,373; U.S. Pat. No. 4,182,591, and U.S. Pat. No. 4,572,700.

As discussed in detail in U.S. Pat. No. 4,572,700, many of these prior art drainage systems are relatively expensive to install due to being labor-intensive, and/or requiring removal and replacement of relatively large volumes of indigenous soil with preferred aggregate and/or sand backfill, processes involving extensive transportation of soil and backfill. Other products such as the drain strips shown in U.S. Pat. Nos. 4,639,165 and 4,572,700, intended to be less costly to install, are relatively fragile in their construction, and tend to not support the filter fabric adequately against soil pressures, particularly during backfilling.

DISCLOSURE OF INVENTION

The invention provides a drainage tube construction comprising a plurality of longitudinally extending, substantially tangential, parallel, corrugated tubes having perforations to allow fluid to enter therein and be drained away. Desirably the drainage tube construction is encased in a suitable fluid permeable filter. The tubes are oriented with respect to one another in a generally linear fashion so that, in transverse cross-section, the portions attaching the tubes to one another define a line generally perpendicular to the longitudinal dimension of the tubes. The drainage tube construction may be placed in a longitudinal trench with the respective tubes being generally vertically stacked with respect to one another, thereby defining a generally vertically extending, longitudinal drainage passage in the soil.

The drainage tube system may be mass manufactured in strips of, e g., twenty four adjacent tubes attached to one another in a linear fashion. The tubes then may be separable from one another in groups, e.g., to form four identical strips having eight tubes each.

BEST MODE FOR CARRYING OUT THE INVENTION

Figure 1:
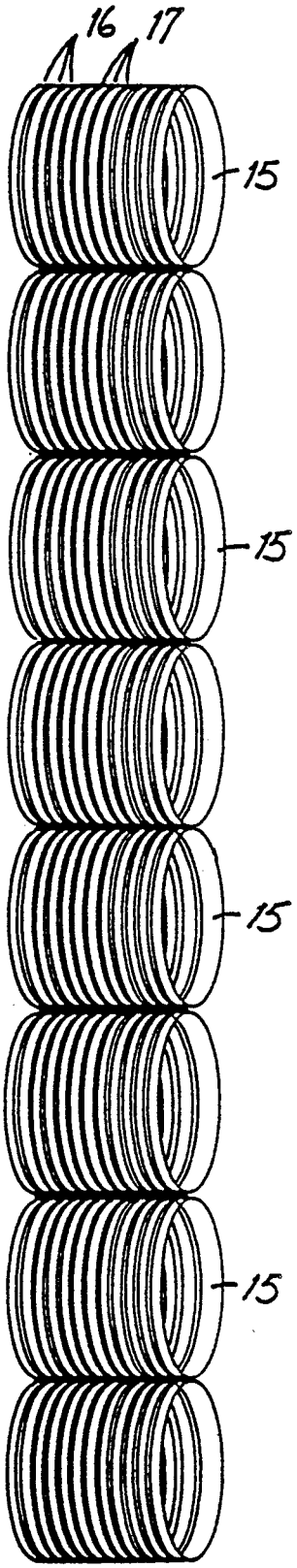
FIG. 1 is a perspective, partially broken-away view of the drainage tube construction of the invention.
Figure 2:
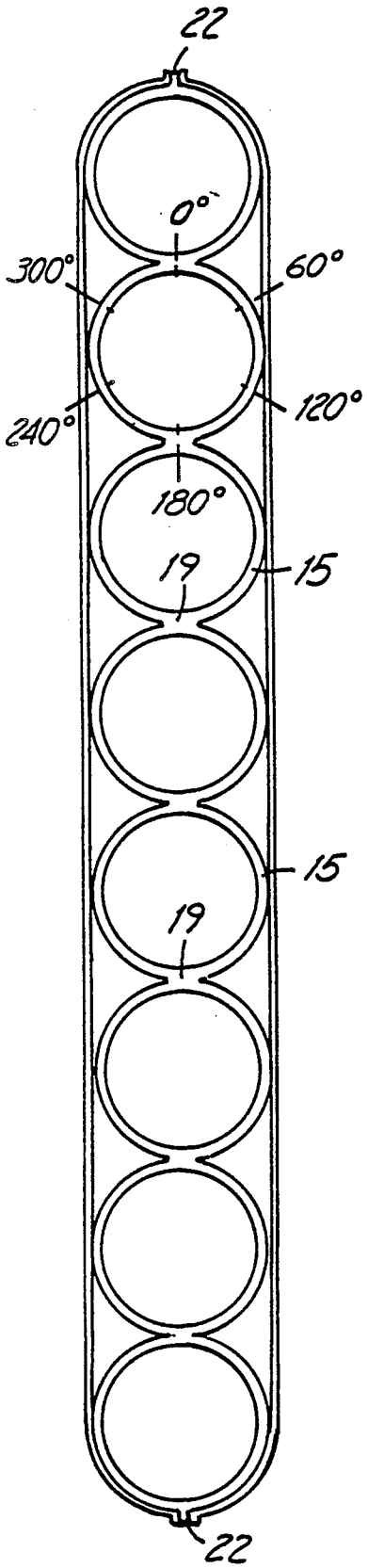
FIG. 2 is an end view of FIG. 1, also depicting a filter wrapped about the drainage tube construction.

Referring to FIGS. 1–2, a drainage tube construction is depicted having, by way of example, eight longitudinally extending, corrugated tubes (15). The tubes (15) are generally tangential to one another, arranged in a generally linear, vertical fashion with respect to one another. Round corrugated drainage tubing is well known and used in a variety of drainage applications. See, e.g., U.S. Pat. No. 3,830,373. The corrugations not only provide radial strength to the tube but also impart flexibility to allow the tube to be coiled for storage and transportation purposes and also to be installed in applications requiring bendable or curved tubing.

Circular structures possess great strength and resistance to compression forces such as must be endured by any subsurface drainage system. The stacked tube design of the invention utilizes the circular design in a unique fashion which gives increased surface area and vertical height to the drainage system, without significantly sacrificing strength or flexibility. Because the overall thickness of the system is substantially less than conventional round drainage tubing, trenches can be substantially narrower, reducing costs associated with excavation and back-filling.

Figure 4:
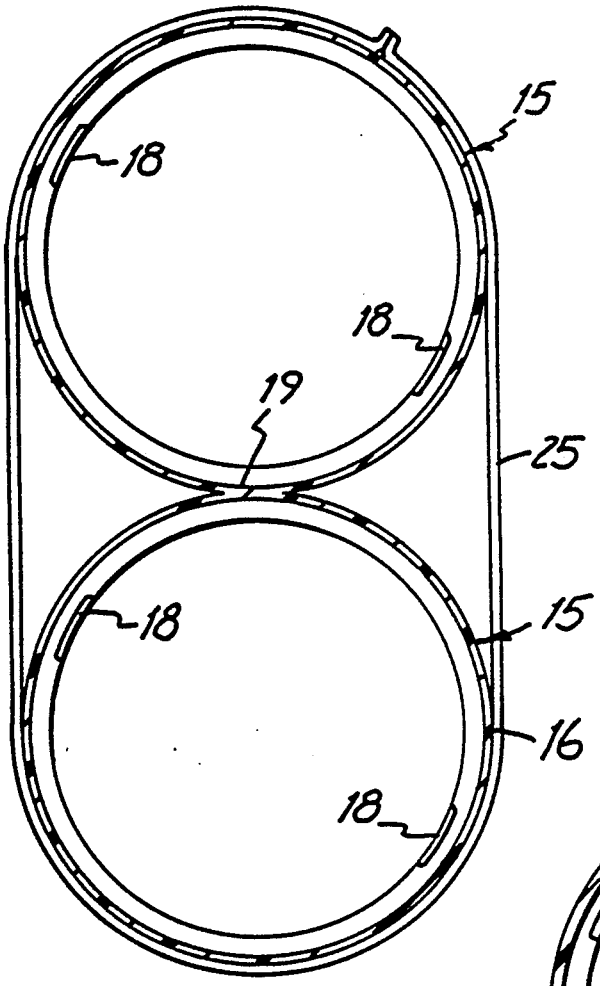
FIG. 4 is a cross-sectional view of FIG. 3 taken along line 4—4 thereof.

Perforations (18) are provided in either the ribs (16) or valleys (17) to permit entry of fluid into the tubing. Preferably the perforations are in the valleys (17). As shown in FIG. 2, a geotextile filter fabric (25) may be wrapped around the drainage tube construction to reduce or eliminate clogging of the system due to infiltration of sediment. The fabric (25) may be fastened in any suitable fashion. In FIG. 2 continuous tabs (22) are formed along the top and bottom surfaces of the tubing system, the fabric (25) being heat or ultrasonically welded to the tabs (22). Alternately, the fabric (25) may be welded in a "praying hands" fashion as shown in FIG. 4, or in any other suitable way.

In some applications, it may be desirable to provide perforations (18) at all angular orientations to facilitate certain drainage characteristics. If desired, however, perforations (18) may be placed in preferred angular orientations to inhibit escape of water from a tube (15) once it has entered through a perforation (18). For example, referring to FIG. 2, it can be seen that the tubes (15) are generally vertically stacked with respect to one another, each tube (15) except the top tube (15) being attached at a 0° position to the next tube (15) above it at the next tube's approximately 180° position Thus, the adjoining portions (19) of each of the tubes (15) define a line generally perpendicular to the longitudinal dimensions of the tubes (15).

In a preferred embodiment, the perforations in each tube are located within an approximately 240° arc bounded approximately by the 240° and 120° positions of the tubes. Thus, the bottom approximately 120° portion of each tube (15) will not contain any perforations, thereby preventing water from escaping from the tube (15) into the soil. In an especially preferred embodiment the perforations (18) are located within an approximately 180° arc ounded by the 270° and 90° positions (and containing the 0° position), rendering the bottom 180° portion of each tube (15) free from perforations (18).

This preferred angular orientation of perforations (18) is particularly useful in drainage applications where water is carried from generally wet areas through drier areas before being discharged into a drainage ditch. Prior art drainage systems allow water to escape from the drainage tube when passing through such drier areas. Although normally the wettest areas of land are the lower areas of a drainage system, localized, elevated wet spots are encountered, particularly in road construction or building construction, due to a variety of causes, including broken underground water mains, open fire hydrants, underground springs, or other idiosyncrasies of surface drainage characteristics.

The size and frequency of perforations (18) may be adjusted to fit the demands of any particular application. In one preferred embodiment, each tube (15) has perforations (18) centered at the 60°, 120°, 240°, and 300° locations; each valley (17) of each tube (15) has two perforations (18) at opposing locations (such as 60° and 240°), with alternating valleys (17) having perforations (18) in alternating positions. Thus, a first valley (17) has perforations (18) in the 60° and 240° positions, the next adjacent valley (17) having perforations (18) in the 120° and 300° positions, and so forth.

Each perforation (18) desirably extends the entire width of the valley (17) and may even extend slightly into the adjacent rib walls. Circular perforations (18) may be formed by drilling or piercing by a round object. Perforations (18) may also be formed in a generally rectangular fashion through blade piercing or slotting with a rotating blade of the desired width.

Figure 3:
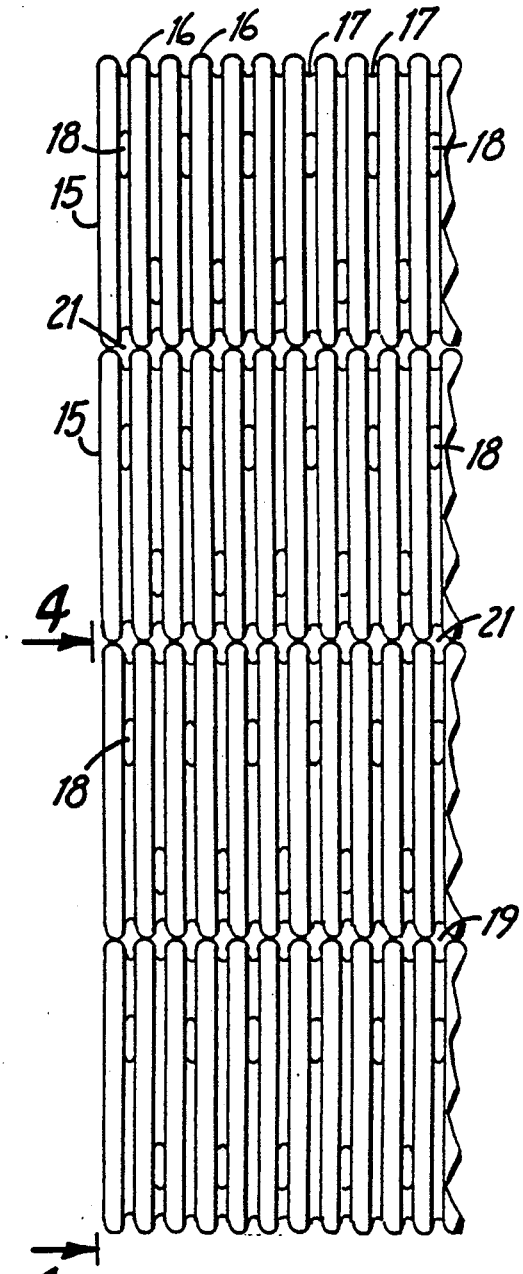
FIG. 3 is a side, broken-away view of a drainage tube construction of the invention.
Figure 6:
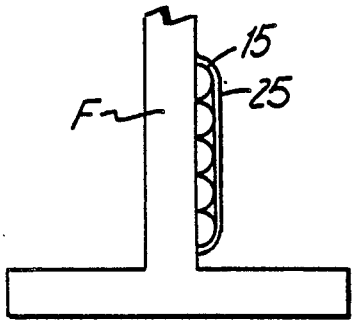
FIG. 6 is a cross sectional view of yet an other alternate embodiment of the invention.

In certain applications, such as around the exterior foundations of buildings, it may be necessary or desirable to have perforations (18) on only one side of the system, namely the side away from the foundation wall. Likewise, in such applications, the filter fabric (25), if desired, may be attached to only one side of the tubing system. Referring to FIG. 3, a side view of a four tube system, it can be seen that the alternating ribs (16) and valleys (17) define lateral gaps (21) permitting lateral fluid flow from one side of the system to the other. In applications having perforations (18) on one side only, it may be desirable to inhibit such fluid flow, and this may be accomplished by integrally molding a thin web across the lateral gaps (21). Alternately, the tubes (15) may be configured in a hemi tubular fashion as shown in FIG. 6. This configuration preserves the benefit of the circular/arcuate strength of the tubes (15) while providing a close fit and better seal against the foundation (F).

In a preferred embodiment shown in FIG. 3, each rib (16) of each tube (15) is attached to a rib (16) of the next adjacent tube (15). If desired, however, only some of the ribs (16) need be attached to adjacent ribs (16), e.g., every other rib (16), or every fifth or tenth rib (16). The attachment between ribs (16) may be such as to allow separation of the tubes (15) from one another. For example, for ease of manufacture, it may be desirable to mold simultaneously a system having 24 adjacent tubes (15). In the field, most applications may require only, e.g., eight tubes, such as shown in FIGS. 1–2, or, e.g., four tubes (15) as shown in FIG. 3. The tubes therefore may be separable from one another, allowing a single 24 tube construction to be split into three eight tube systems.

Figure 5:
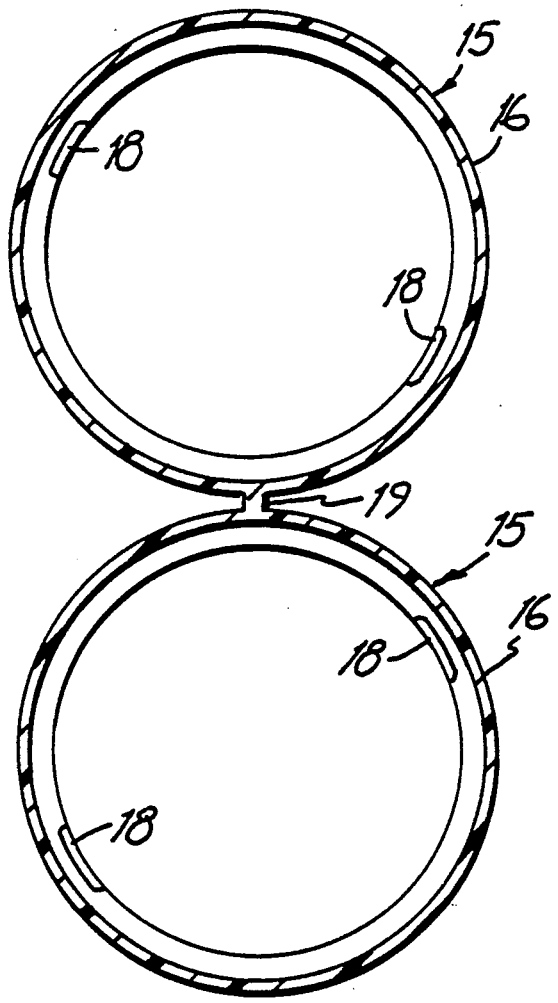
FIG. 5 is a cross sectional view of an alternate embodiment of the invention.

The attachment of the separable tubes (15) to one another in such situations may be constructed weaker than the actual ribs (16), so that as the tubes (15) are being separated the ribs (16) are left intact. FIG. 5 depicts one embodiment suited for such separation. The portion (19) attaching one tube (15) to the next is manufactured to be weaker than the wall of the rib (16). The tubes (15) may then be easily separated, either by mechanically cutting the portion (19), or by physically tearing the portion (19) by pulling one tube (15) laterally away from the other. Tubes (15) designed to be separated from one another desirably may have only a fraction of ribs (16) attached on to the other to facilitate such separation.

Figure 7:
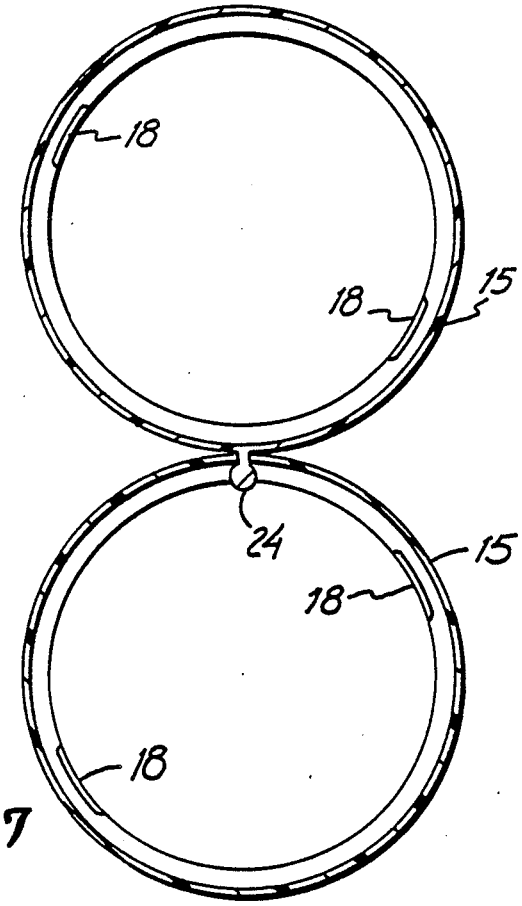
FIG. 7 is a cross sectional view of yet an other alternate embodiment of the invention.

In some situations it may be desirable not only to permit separation of tubes (15) but also to permit assembly (or re assembly) of tubes (15) to one another. In such situations, attachment between successive tubes (15) may be accomplished by utilizing a snap fit connection on a fraction of the ribs (16), as shown in FIG. 7, the remaining ribs (16) being unattached to adjacent tubes (15). In one such embodiment, every rib (16) contains a perforation at the 0° location, and every, e.g., fifth rib (16) has a ball/stem appendage at the 180° position, the ball (23) having a diameter slightly larger than the diameter of the 0° perforations. When pressed into the perforations, the balls (23) are snugly retained therein until pulled apart with sufficient force to overcome the snap fit. Such configurations might be particularly useful for custom fitting drainage applications in and around building foundations.

Figure 8:
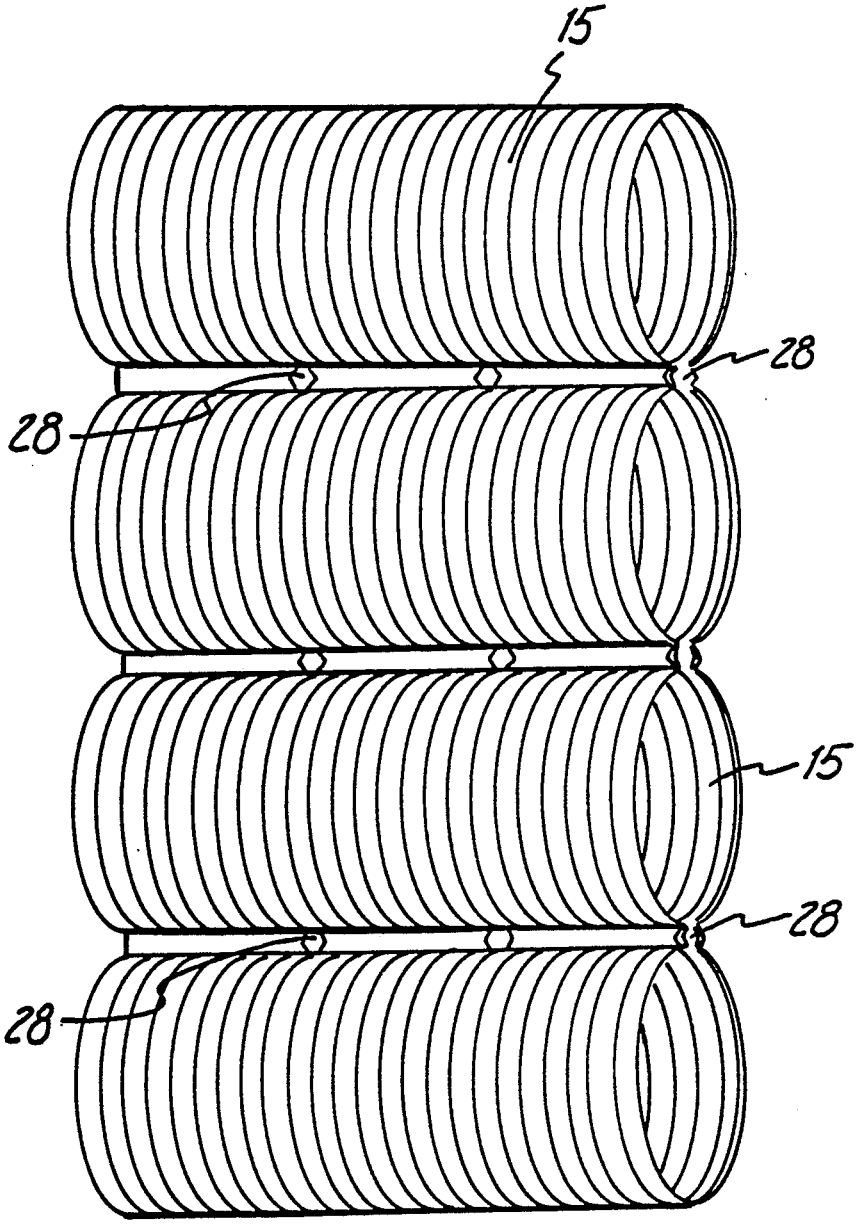
FIG. 8 is a perspective, partially broken-away view of yet another alternate embodiment of the invention.

In an alternative embodiment of the invention shown in FIG. 8, the corrugated tubes (15) may be connected by a web of material (19) and may include spaced vertical drainage channels (28) for allowing fluid to drain vertically from an upper tube to an adjacent lower tube. The vertical drainage between adjacent tubes allows the system to effectively drain small amounts of fluid by merging small fluid streams contained in several drainage tubes into larger streams in the lower drainage tubes. The vertical drainage channels (28) may be sized and varied in their spacing as desired to attain a desired amount of vertical drainage. In a preferred embodiment, adjacent vertical drainage channels (28) are spaced approximately 3–4 inches apart, and drainage channels (28) in adjacent tubes are staggered from one another to preserve flexibility. In a particularly preferred embodiment of this type twelve tubes of 1" I.D. and 1.25" O.D. are manufactured having connecting web portions between tubes of about 0.25", the entire construction therefore being about 18" in height. Vertical drainage channels (28) are located about every four inches, channels (28) in adjacent tubes being staggered by about 2 inches.

A drainage tube construction of the invention may be manufactured by conventional blow molding or vacuum molding techniques commonly employed and well known in the manufacture of corrugated drainage tubing. The tubing itself may be made from polyethylene, polyvinylchloride (PVC), or other suitable substances. In a preferred manufacturing technique a strip of 24 adjacent tubes (15) is molded simultaneously and integrally in continuous lengths which are periodically cut and rolled or coiled onto suitable spools for storage and transportation purposes prior to use. Some of the tubes (15) are joined to one another inseparably, or in a separable fashion to permit either factory separation or separation in the field into strips of drainage tubing having, e.g., eight adjacent tubes. Alternately, the tubes may be manufactured as single, unattached tubes having the aforementioned snap fit design (or equivalent attachment means) and then assembled in the factory or in the field into multi tube strips.

The size of the tubes (15) ca be varied to accommodate different applications of the drainage system. In a preferred system designed for use as an edge drain along the shoulders of highways, a system having eight tubes (15), each of approximately 1.25 in. I.D. (about 1.625 in. O.D.) is desirable. In such a system having the general proportions shown in FIG. 3, it has been found that high density polyethylene tubing having ribs about 3/16 in. in depth provides adequate strength against exterior compression forces while utilizing an economical amount of actual material. Such a system with eight tubes desirably would utilize approximately 350 grams of material per linear foot.

In a preferred manufacturing process the corrugated drainage tubing is manufactured by a molding process according to U.S. Pat. No. 4,439,130, the teachings of which are hereby incorporated by reference. In utilizing this continuous vacuum molding process, a plurality of mating vacuum mold assemblies (30), each, e.g., a few inches in length, are constructed conforming to the desired external configuration of the drainage tubing. The mold assemblies (30) are mounted adjacent one another for continuous movement about an endless track.

Each mold assembly (30) includes two pivotally connected, mating pieces that are closed during a first segment of the endless track to form an open-ended molding tunnel (34). When the mold assemblies reach the end of this segment they pivotally open, releasing the molded tubing, and then return along a second segment of the endless track to the beginning of the first segment, closing again about the extruder head to form the molding tunnel and receive extruded, molten plastic.

Figure 10:
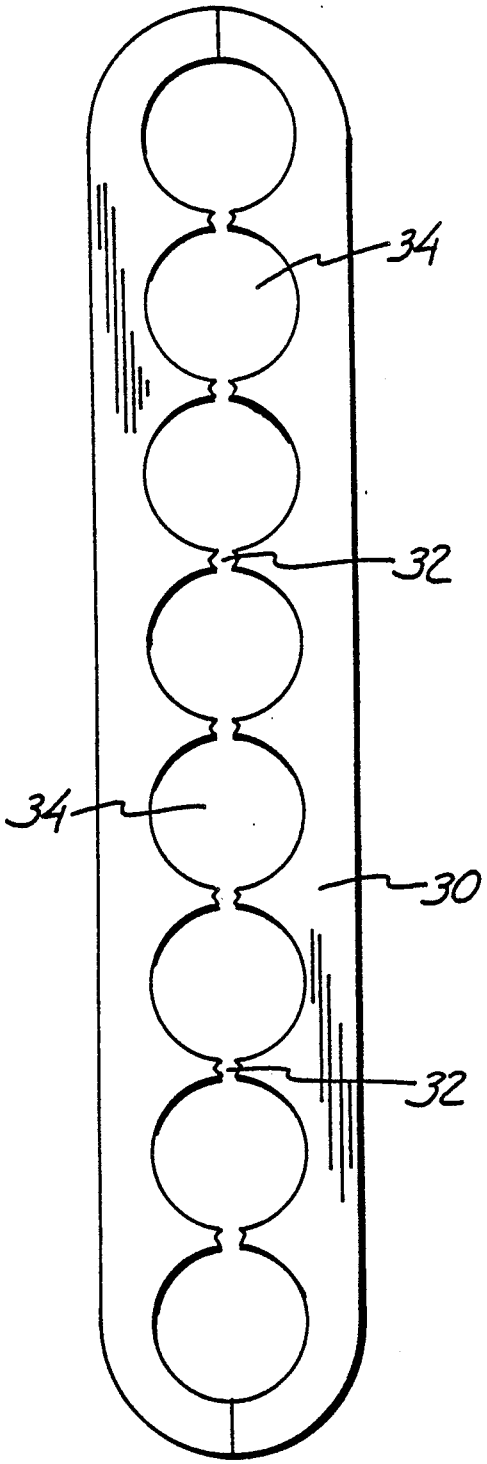
FIG. 10 is an end view of a mold assembly used to form tubing of the invention.
Figure 11:
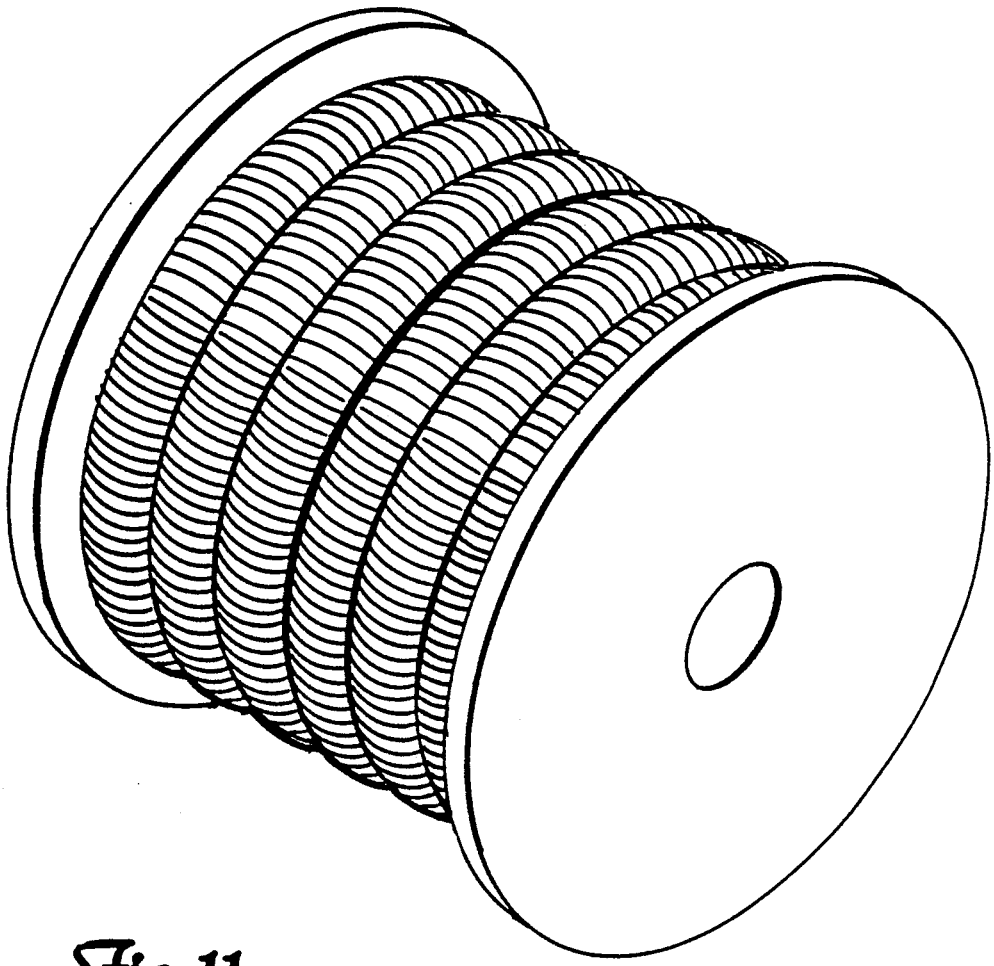

In a preferred embodiment, the mold assemblies (30) include periodic cavities (32) between adjacent tubes for forming the vertical drainage channels (28) between adjacent tubes. FIG. 10 depicts such a mold for forming eight adjacent tubes.

Figure 9:
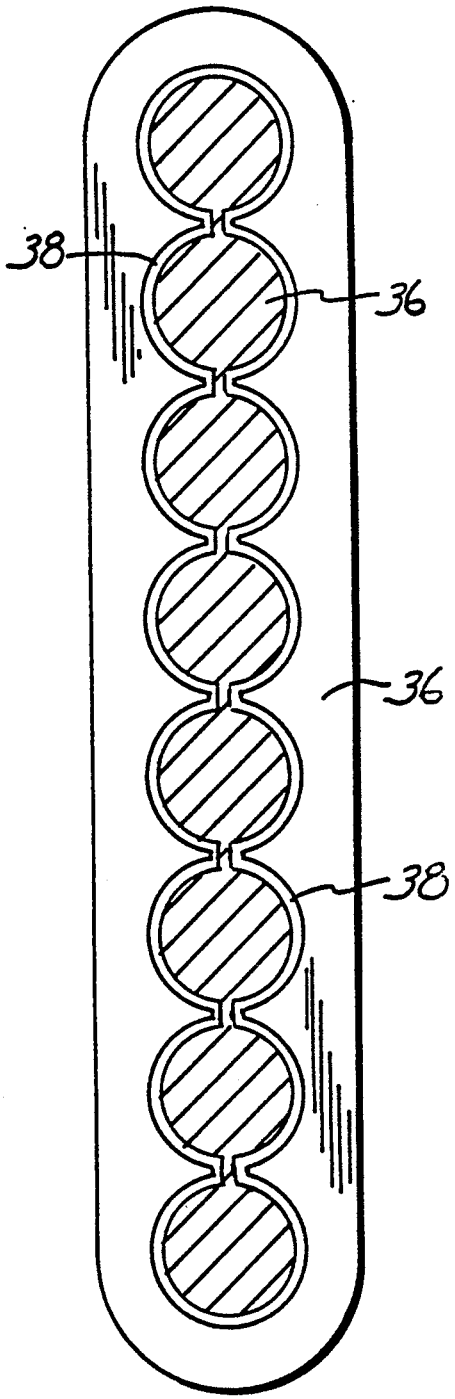
FIG. 9 is an end on view of an extruder head used in connection with the mold assembly of FIG. 10.

The shaped extrusion orifice (38) of the extruder (through which molten plastic is supplied to the molding tunnel (34)) preferably follows closely the contours of the molds; a preferred head for use with the mold of FIG. 1 is depicted end-on in FIG. 9. Typically, when utilizing the molding process of Pat. No. 4,439,130, the face of the extruder head projects slightly into the closed mold sections (i.e., the molding tunnel) so that plastic extruding from the head is immediately contacted and supported by the closed mold assemblies.

In utilizing the head of FIG. with the mold assemblies of FIG. 10, however, it is necessary to move the extruding head just outside of the molding tunnel s that it does not interfere with the mold assemblies (30) as they close for molding. It has been found that, once the molding process is initiated, such positioning of the extruder head works well. Initiation of the process (i.e., initial guidance and positioning of the extruding plastic) will be straightforward (gravity assisted) if the molding tunnel is oriented vertically. Initiation of the process in the traditional horizontal orientation may require manual assistance and/or result in a short segment of malformed tubing which merely is cut off and discarded.

Installation of tubing of the invention begins by digging or otherwise preparing a trench of appropriate width and depth. Because the tubing is relatively narrow, the trench need not be as wide as is required by many of the prior art drainage systems. The drainage tubing is then placed in the trench and covered with backfill. Depending upon the indigenous soil, the backfill may not require any special treatment or mixture. In some drainage soils, it may be desirable to incorporate varying amounts of sand and/or aggregate in the backfill. Furthermore, depending upon existing conditions, a geotextile fabric may be wrapped around the tubing system. Such geotextiles may be applied to the tubing at the factory, or, in some circumstances, in the field, utilizing well known techniques.

Sections of tubing may be Joined end-to-end using any of a variety of well known methods, including mechanical coupling and solvent welding. Low points in the installed system typically are connected to main drain lines, or alternately, allowed to drain into drainage ditches or other natural bodies of water. If desired, a manifold may be provided at the end of a particular run of tubing to consolidate the multiple tubes to a single tube.

It will be understood that because the tubing system of the invention will conduct any type of fluids, including, of course, both liquids and gases, the term "fluid" as used herein is meant to include both liquids and gases. In an alternate application of the invention, a tubing system according to the invention might be installed in a horizontal orientation beneath building basement floor slabs for the purpose of ventilating unwanted gases such as radon. In particular, courses of tubing may be laid horizontally prior to pouring the basement concrete floor of a home, thereby covering a significant fraction of the floor area. Manifolds and suitable joining members would allow consolidation of the fluid chambers defined by the tubing system, eventually venting the system to the exterior of the building as through a roof vent or suitable vents in other portions of the building. If desired, the ground may be prepared by laying a suitable bed of gravel or crushed rock to facilitate movement of gases to the tubing system members. Such a system might also be consolidated with a foundation drainage system.

While a preferred embodiment of the present invention has been described, it should be understood that various changes, adaptations, and modifications may be made therein without departing from the spirit of the invention and the scope of the appended claims.

What is claimed is:

1. A ground drainage system comprising a relatively narrow, elongated trench disposed along a roadway (or agricultural field); and a drainage tube construction disposed in the trench, said construction including a plurality of longitudinally extending, substantially tangential and generally parallel corrugated tubes oriented with respect to one another in a linear fashion so that in transverse cross-section the portions attaching the tubes to one another define a generally straight line perpendicular t the longitudinal dimension of the tubes, the tubes being generally vertically stacked with respect to one another, each tube except a top tube being attached at a 0° position to the next tube above it at the next tube's approximately 180° position, the corrugations being defined by alternating ribs and valleys, each tube having perforations in the valleys to allow fluid to enter therein and be drained away; the trench being backfilled with drainage soil to cover the drainage tube construction.

2. The drainage system of claim 1 wherein the construction is flexible along its longitudinal dimension, permitting it to be coiled about a spool for storage and transportation prior to being buried in said trench.

3. The drainage system of claim 1 wherein the trench is substantially deeper than it is wide.

4. The drainage system of claim 1 wherein each tube is attached by a generally continuous web to an adjacent tube.

5. The drainage system of claim 1 wherein the tubes are generally circular in cross section.

6. A ground drainage system comprising a relatively narrow, elongated drainage tube construction disposed along an agricultural field in the ground, some of the tubes being in fluid communication with adjacent tubes through a plurality of generally vertical passageways therebetween spaced along the length of the tubes, said construction including a plurality of longitudinally extending, physically attached parallel tubes in a generally vertically stacked and horizontally extending orientation, the tubes having perforations to allow fluid to enter therein and be drained away, the construction being buried in drainage soil to cover the drainage tube construction.

7. A ground drainage system comprising a relatively narrow, elongated trench disposed along a roadway, and a drainage tube construction disposed in the trench, said construction including a plurality of longitudinally extending, physically attached, parallel tubes in a generally vertically stacked and horizontally extending orientation, the tubes having perforations to allow fluid to enter therein and be drained away, some of the tubes being in fluid communication with adjacent tubes through a plurality of generally vertical passageways therebetween spaced along the length of the tubes, the trench being backfilled with drainage soil to cover the drainage tube construction.

8. The drainage system of claim 7 wherein the tubes are oriented with respect to one another in a generally linear fashion so that in transverse cross-section the portions attaching the tubes to one another define a generally straight line perpendicular to the longitudinal dimension of the tubes.

9. The drainage system of claim 8 wherein each tube except a top tube is attached at a 0° position to the next tube above it at the next tube's approximately 180° position.

* * * * *